US006443693B1

(12) United States Patent
Eck

(10) Patent No.: US 6,443,693 B1
(45) Date of Patent: Sep. 3, 2002

(54) FUEL PUMP

(75) Inventor: Karl Eck, Frankfurt (DE)

(73) Assignee: Mannesman VDO AG, Frankfurt am Main (DE)

( * ) Notice: Subject to any disclaimer, the term of this patent is extended or adjusted under 35 U.S.C. 154(b) by 0 days.

(21) Appl. No.: 09/718,657

(22) Filed: Nov. 22, 2000

(30) Foreign Application Priority Data

Nov. 23, 1999 (DE) ..... 199 56 144
Nov. 3, 2000 (DE) ..... 100 54 590

(51) Int. Cl.[7] ..... F04D 5/00

(52) U.S. Cl. ..... 415/55.1; 415/121.2; 415/211.2; 415/224

(58) Field of Search ..... 415/55.1, 55.5, 415/55.7, 121.2, 211.2, 224, 226; 123/509, 510, 514

(56) References Cited

U.S. PATENT DOCUMENTS 5,289,810 A * 3/1994 Bauer et al. ..... 123/510
5,413,457 A 5/1995 Tuckey ..... 415/55.6
5,452,701 A * 9/1995 Tuckey ..... 123/509
5,961,276 A * 10/1999 Huebel et al. ..... 415/55.1
6,152,686 A * 11/2000 Neidhard et al. ..... 415/55.1
6,152,688 A * 11/2000 Staab et al. ..... 415/55.5
6,162,012 A * 12/2000 Tuckey et al. ..... 415/55.1

FOREIGN PATENT DOCUMENTS

| | | | |
|---|---|---|---|
| DE | 41 11 341 A1 | 10/1992 | ..... F02M/37/20 |
| DE | 33 03 352 A1 | 2/1996 | ..... F04D/5/00 |
| DE | 44 27 540 A1 | 2/1996 | ..... F02M/37/04 |
| DE | 195 06 040 C2 | 11/1997 | ..... F04D/5/00 |
| DE | 197 19 609 | 11/1998 | ..... F04D/5/00 |
| GB | 2 134 598 | 12/1983 | ..... F04D/5/00 |

OTHER PUBLICATIONS

English Abstract for DE 41 11 341.
English Abstract for DE 44 21 540.

* cited by examiner

*Primary Examiner*—Edward K. Look
*Assistant Examiner*—Ninh Nguyen
(74) *Attorney, Agent, or Firm*—Cohen, Pontani, Lieberman & Pavane

(57) ABSTRACT

A fuel pump for a motor vehicle has an outlet duct leading to an internal combustion engine and a connection leading to an ejector, and two delivery chambers which are separate from one another. The delivery chambers are concentric so that one surrounds the other. The fuel pump is simple to construct and can be manufactured at favorable cost.

16 Claims, 6 Drawing Sheets

FUEL PUMP

BACKGROUND OF THE INVENTION

1. Field of the Invention

The invention relates to a fuel pump for arrangement in a fuel tank for delivering fuel to an internal combustion engine of a motor vehicle, the fuel pump having a rotor with guide vanes rotatably arranged in a pump housing and part annular ducts arranged in the pump housing and bounding one ring of vane chambers to form delivery chambers leading from an inlet duct to an outlet duct, the delivery chambers having a further connection for supplying an ejector which delivers fuel within the fuel tank.

2. Description of the Related Art

Fuel pumps which simultaneously supply at least one ejector with fuel and deliver fuel to the internal combustion engine of the motor vehicle are frequently employed in present-day motor vehicles and are known from practice. The known fuel pumps have a single delivery chamber. Fuel is delivered through the delivery chamber to the outlet duct and to the connection leading to the ejector. A valve which opens above a specified pressure is arranged in the connection leading to the ejector. This ensures that, below the specified pressure, the entire portion of fuel delivered by the pump is directed to the internal combustion engine.

A disadvantageous feature of the known fuel pump is that the valve represents a cost-intensive component and is susceptible to fault. In addition, the quantity and pressure of the fuel delivered to the internal combustion engine fluctuates due to the switching of the valve.

SUMMARY OF THE INVENTION

An object of the present invention is to design a fuel pump for delivering fuel to an ejector and to an internal combustion engine so that the quantity and pressure of the fuel delivered to the internal combustion engine is independent of the fuel delivered to the ejector and so that the pump is easy to construct.

The object of the present invention is met by a pump having an outlet duct through which fuel is pumped to an internal combustion engine and a connection to an ejector for pumping fuel within the fuel tank, the pump having separate delivery chambers leading to the outlet duct and to the connection.

The fuel pump according to the present invention has, due to the separate delivery chambers, two mutually independent pumps arranged with a common rotor. The fuel pump according to the invention is simply arranged for the pressure and the quantity of the fuel to be delivered to the internal combustion engine by appropriate design of a first delivery chamber leading to the outlet duct. By this means, the internal combustion engine always receives the necessary fuel quantity and pressure. A second delivery chamber feeds the ejector and is separate from the first delivery chamber. The second delivery chamber may also be appropriately designed to deliver the necessary amount of fuel to the ejector. The present invention obviates the need for a valve for controlling the fuel delivered to the ejector or to the internal combustion engine. A further advantage of the invention is that fuel in the connection to the ejector flows in a particularly eddy-free manner, undisturbed by the valve of the known fuel pump. This allows a high fuel pump efficiency.

The fuel pump according to the present invention may be simply designed if the first and second delivery chambers respectively leading to the outlet duct and to the connection are concentrically arranged so that one surrounds the other. The length, diameter and position of the delivery chambers, for example, may be designed to meet the specified fuel pressure and the fuel quantity to be delivered.

It is possible to include separate inlet ducts for each of the delivery chambers so that the delivery chambers are like separate pumps. However, connecting the delivery chambers to a common inlet duct helps reduce the manufacturing costs of the fuel pump according to the present invention.

Mutual influence on the fuel flowing in the inlet duct to the two delivery chambers may be avoided by arranging a partition in the inlet duct extending from a fuel filter to the rotor so that the inlet duct on one side of the partition leads to the radially inner delivery chamber and the inlet duct on the other side of the partition leads to the radially outer delivery chamber. This partition may be provided during the manufacture of the pump housing or may be subsequently inserted in the inlet duct.

The ejector connected to the connection obtains a sufficient quantity of fuel for filling the surge chamber in the fuel tank if the delivery chamber leading to the connection is configured to be smaller than the delivery chamber leading to the outlet duct.

Compensation may be simply provided for the forces acting on the rotor if the connection and the outlet duct are located orthogonally to mutually opposite end faces of the rotor.

The rings of guide vanes may, for example, be arranged in the end faces of the rotor as in side channel pumps. The fuel pump according to the present invention may alternatively have a design which is particularly economical in space if the radially outer ring of guide vanes is arranged at the outer periphery of the rotor.

The guide vanes arranged on the outer periphery may, for example, extend over the whole height, i.e., axial length, of the rotor or may be arranged over the corner regions on the end faces as in the case of a peripheral pump. The cross section of the delivery chamber leading to the connection for the ejector may be particularly compactly designed if the radially outer ring of guide vanes protrudes from the outer periphery of the rotor in a partial region of its height and if the part-annular duct corresponding to the outer ring of guide vanes is configured in the manner of a groove.

To further reduce the manufacturing costs of the fuel pump according to the invention, the part-annular duct may be configured in the manner of a groove substantially arranged in one of the housing parts and is laterally bounded by the other housing part.

The fuel pump according to the present invention may comprise particularly small radial dimensions if the delivery chambers leading to the outlet duct and to the connection are arranged one behind the other viewed in the direction of rotation of the rotor, i.e., the circumferential direction. This design further reduces the manufacturing costs for the fuel pump according to the present invention, because the rotor then only requires a single ring of guide vanes.

The internal combustion engine and the ejector respectively receive the specified quantity of fuel if the first delivery chamber leading to the connection is shorter than the second delivery chamber.

Each of the delivery chambers could, for example, be connected by its own inlet duct to a fuel filter. To further reduce the manufacturing costs of the fuel pump according to the present invention, the inlet ducts leading to the delivery chambers may include a connection to a common fuel filter.

The connection of the fuel filter to the pump housing is of particularly simple design if the inlet duct branches within the pump housing to the individual delivery chambers.

To provide compensation for axial forces, the connection for the ejector and the outlet duct may be arranged on directly opposed sides of the rotor if the rotor includes one delivery chamber in the region of each of its end faces and if one of the delivery chambers is led to the outlet duct and the other of the delivery chambers is led to the connection.

During the initial filling of the fuel tank, only a small quantity of fuel is necessary for operating the internal combustion engine if the inlet duct of the delivery chamber leading to the connection of the ejector is provided for leading on into the fuel tank. This ensures that a small quantity of fuel in the fuel tank is available to the fuel pump, according to the invention, of the internal combustion engine after a short operating period.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
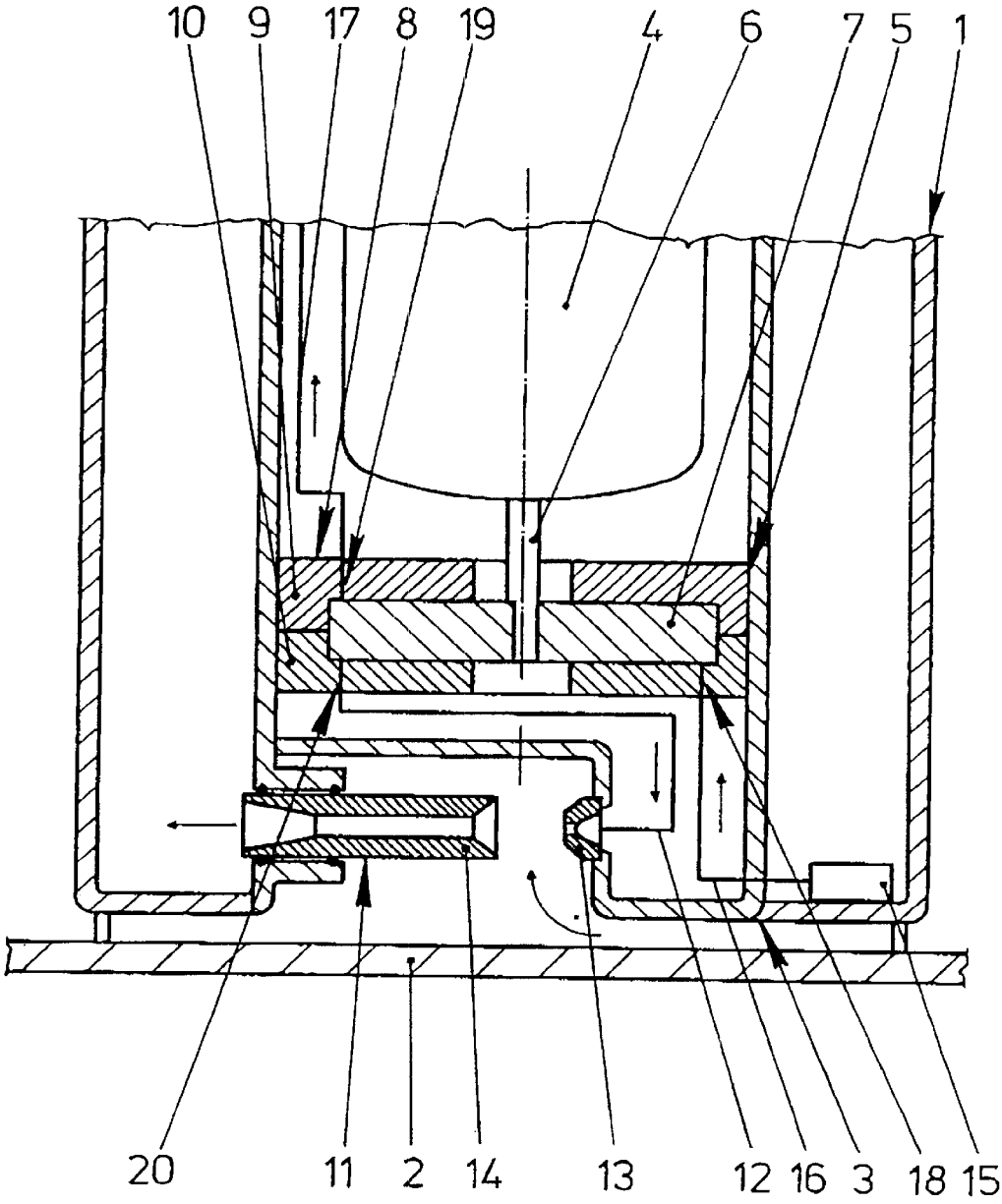
FIG. 1 is a longitudinal sectional diagrammatic view of a delivery unit with a fuel pump in accordance with an embodiment of the present invention arranged in a fuel tank.

FIG. 1 is a diagrammatical representation of a delivery unit 3 fitted in a surge chamber 1 of a fuel tank 2 of a motor vehicle according to the present invention. The delivery unit 3 has a fuel pump 5 driven by an electric motor 4 and is inserted so that it seals in an opening in the floor of the surge chamber 1. The fuel pump 5 has a rotating rotor 7 torsionally fastened on a shaft 6 of the electric motor 4 and has a pump housing 8 with two housing parts 9, 10 between which the rotor 7 is accommodated. An ejector 11 is arranged in the floor region of the delivery unit 3. The ejector 11 is supplied with fuel via an entrainment fluid conduit 12 connected to the fuel pump 5. The fuel supplied to the ejector 11 by the entrainment fluid conduit 12 first reaches a nozzle 13. A mixing tube 14 is fastened in the delivery unit 3 opposite to the nozzle 13. The ejector 11 sucks fuel from the fuel tank 2 and delivers it to the surge chamber 1 via the mixing tube 14. A fuel filter (not shown) may be arranged between the mixing tube 14 and the fuel tank 2. The fuel pump 5 draws fuel from the surge chamber 1 through a fuel filter 15 and into a conduit 16 via a suction force. The fuel pump 5 then delivers the fuel via a further conduit 17 to an internal combustion engine (not shown) of the motor vehicle. For clarification, the fuel flows are designated by arrows in the drawing. An inlet duct 18 for drawing in the fuel and an outlet duct 19 connected to the conduit 17 leading to the internal combustion engine are arranged in the pump housing 8. The pump housing 8 further includes a connection 20 for the entrainment fluid conduit 12 leading to the nozzle 13 of the ejector 11.

For drawing simplicity, the inlet duct 18 and the outlet duct 19 are represented offset by 180° in the direction of rotation of the rotor 7. In practice, the angle between the inlet duct 18 and the outlet duct 19 is usually within the range 270° to 330°.

Figure 2:
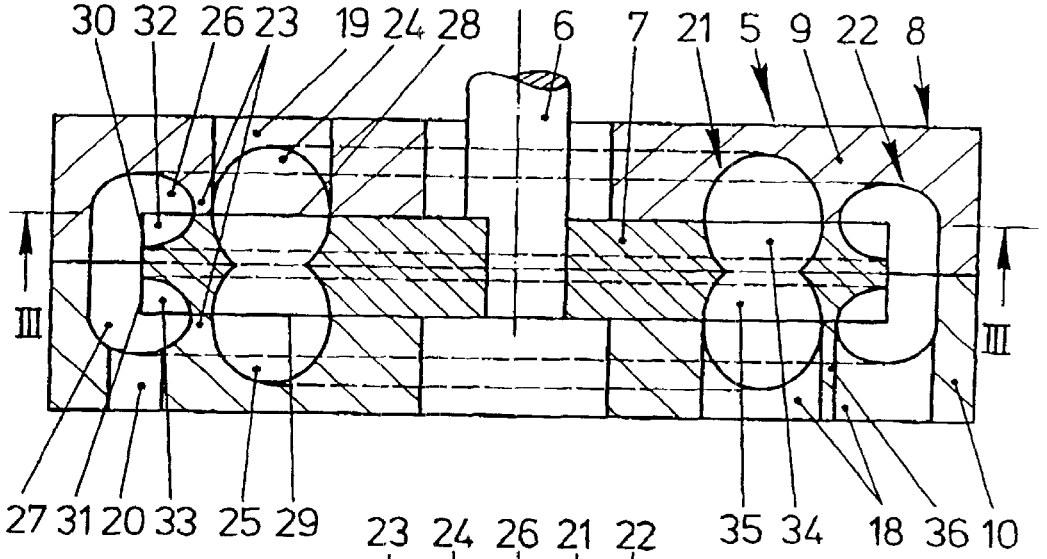
FIG. 2 is a longitudinal sectional view of the fuel pump of FIG. 1 in which the pump has concentric delivery chambers.

FIG. 2 shows the fuel pump 5 of FIG. 1 in longitudinal section. The fuel pump 5 has two concentrically arranged delivery chambers 21, 22. The delivery chambers 21, 22 are separated from one another by a rim 23 in the pump housing 8 which continues as far as the rotor 7. One of the delivery chambers 21 leads from the inlet duct 18 to the outlet duct 19. The other delivery chamber 22 leads from the inlet duct 18 to the connection 20 for the entrainment fluid conduit 12 represented in FIG. 1. The delivery chambers 21, 22 are respectively composed of annular ducts 24 to 27 arranged in the housing parts 9, 10 of the pump housing 8 and of vane chambers 32 to 35 arranged in the rotor 7 and bounded by guide vanes 28 to 31. The guide vanes 28, 29 of the delivery chamber 21 leading to the outlet duct 19 are respectively arranged in the end faces of the rotor 7.

Mutually opposite vane chambers 32, 33 of the delivery chamber 21 leading to the outlet duct 19 are connected to one another so that the delivery chamber 21 leads axially through the rotor 7. Guide vanes 30, 31 of the delivery chamber 22 leading to the connection 20 for the entrainment fluid conduit 12 are arranged on the outer periphery and on the end faces of the rotor 7. The delivery chamber 21 leading to the outlet duct 19 is therefore configured in the manner of a side channel pump, whereas the delivery chamber 22 leading to the connection 20 is configured in the manner of a peripheral pump. The outlet duct 19 and the connection 20 leading to the entrainment fluid conduit 12 represented in FIG. 1 are located on opposite sides of the rotor from one another. The delivery chamber 21 leading to the outlet duct 19 exhibits a larger cross section than the delivery chamber 22 leading to the connection 20 for the entrainment fluid conduit 12. Furthermore, FIG. 2 shows a partition 36 arranged in the inlet duct 18 provided for separating the flows leading to the delivery chambers 21, 22.

Figure 3:
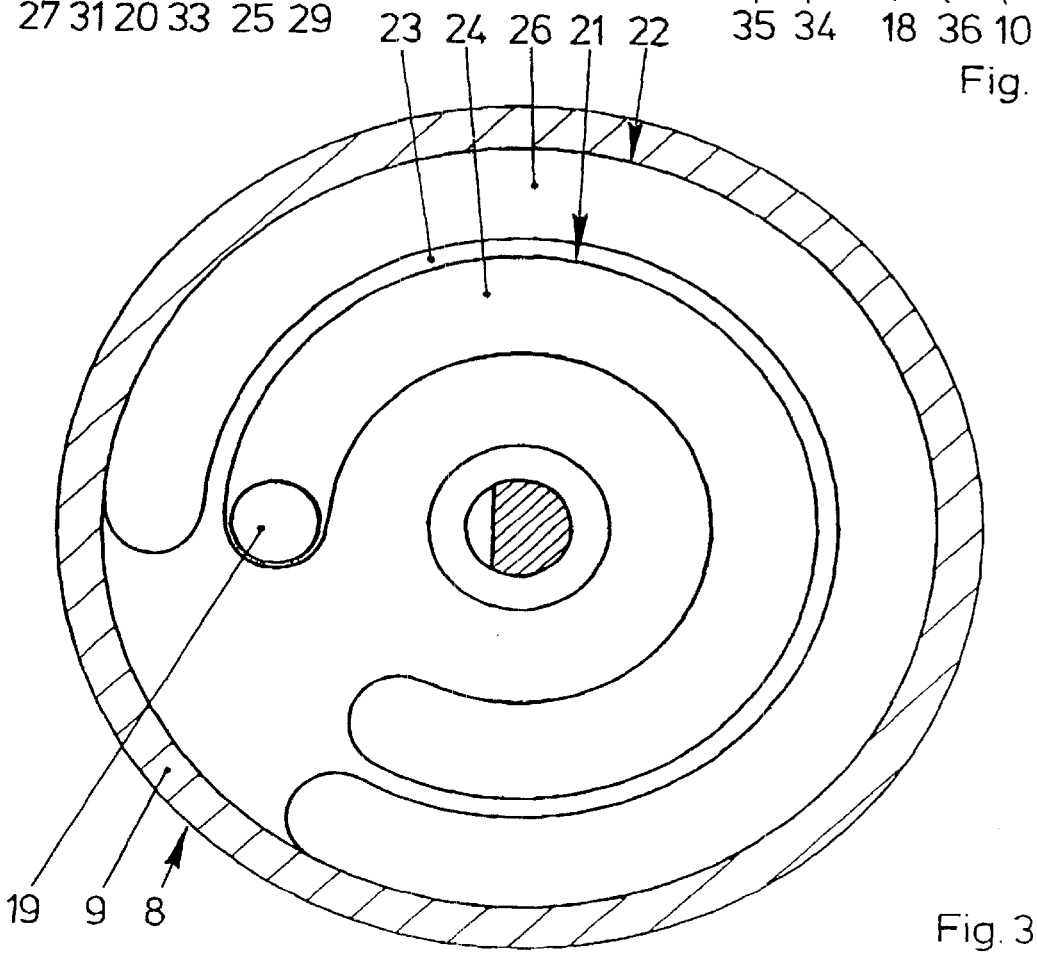
FIG. 3 is a sectional view of the fuel pump in FIG. 2 along the line III—III.

FIG. 3 is a sectional representation through the fuel pump 5 of FIG. 2 along the line III—III showing the housing part 9 of the pump housing 8 and the outlet duct 19. In this embodiment, the angle between the inlet duct 18 represented in FIG. 2 and arranged at the beginning of the delivery chamber 21 is offset by approximately 300° relative to the outlet duct 19. The part-annular ducts 24, 26 of the two delivery chambers 21, 22 respectively extend over the same angular range.

Figure 4:
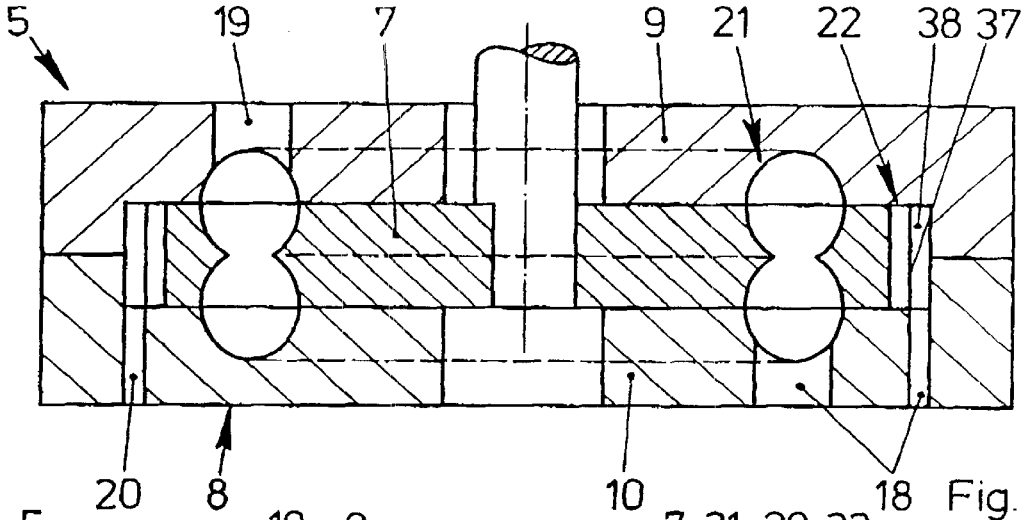
FIG. 4 is a further embodiment of the fuel pump of FIG. 1 with concentric delivery chambers.

FIG. 4 shows a further embodiment of the fuel pump 5 of FIG. 1. In contrast to the embodiment of FIG. 2, the delivery chamber 22 includes guide vanes 37 leading to the connection 20 for the entrainment fluid conduit 12 (FIG. 1) and having a constant dimension over the whole of the height of the rotor 7. A part-annular duct 38 of the delivery chamber 22 is configured as a groove with a width corresponding to the height of the rotor 7.

Figure 5:
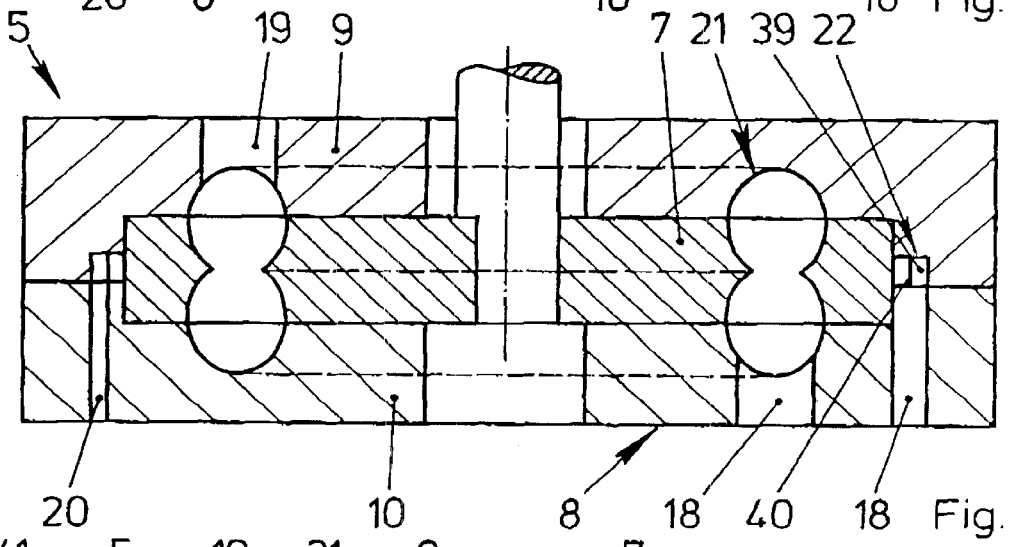
FIG. 5 is a further embodiment of the fuel pump of FIG. 1 with concentric delivery chambers.

In a further embodiment of the fuel pump 5 shown in FIG. 5, a part-annular duct 39 of the delivery chamber 22 leading to the connection 20 only extends over a partial region of the height of the rotor 7. In addition, the part-annular duct 39 is only arranged in the housing parts 9 of the pump housing 8. Accordingly, the other housing part 10 may be particularly cost-favorably manufactured. Guide vanes 40 of the delivery chamber 20 protrude from the periphery of the rotor 7 in this embodiment.

Figure 6:
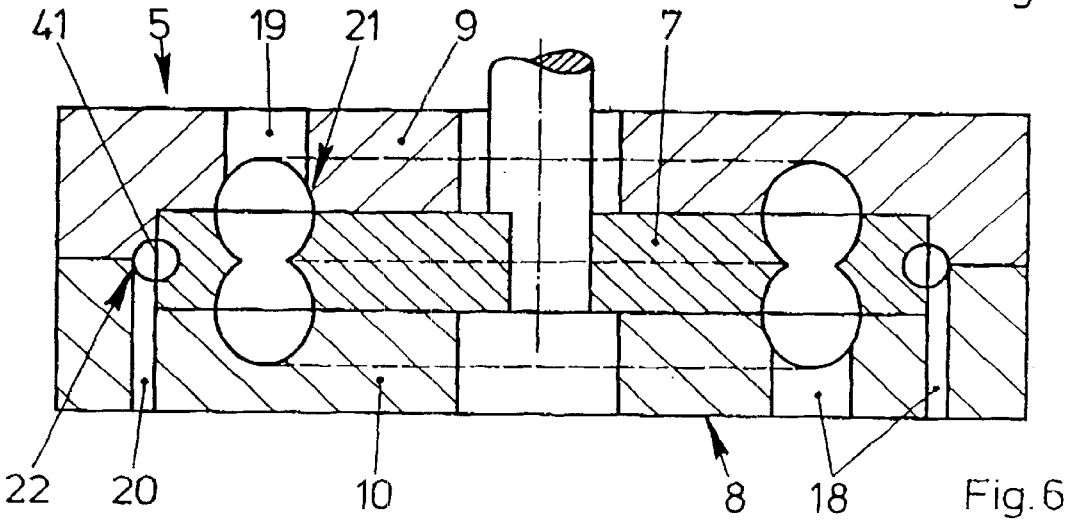
FIG. 6 is yet a further embodiment of the fuel pump of FIG. 1 with concentric delivery chambers.

A further embodiment of the fuel pump 5 according to the present invention is shown in FIG. 6. This embodiment differs the from that of FIG. 5 in that guide vanes 41 of the delivery chamber 22 leading to the connection 20 are arranged within the rotor 7. In addition, the delivery chamber 22 arranged at the periphery of the rotor 7 has a circular cross section optimized for the formation of a circulatory flow.

Figure 7:
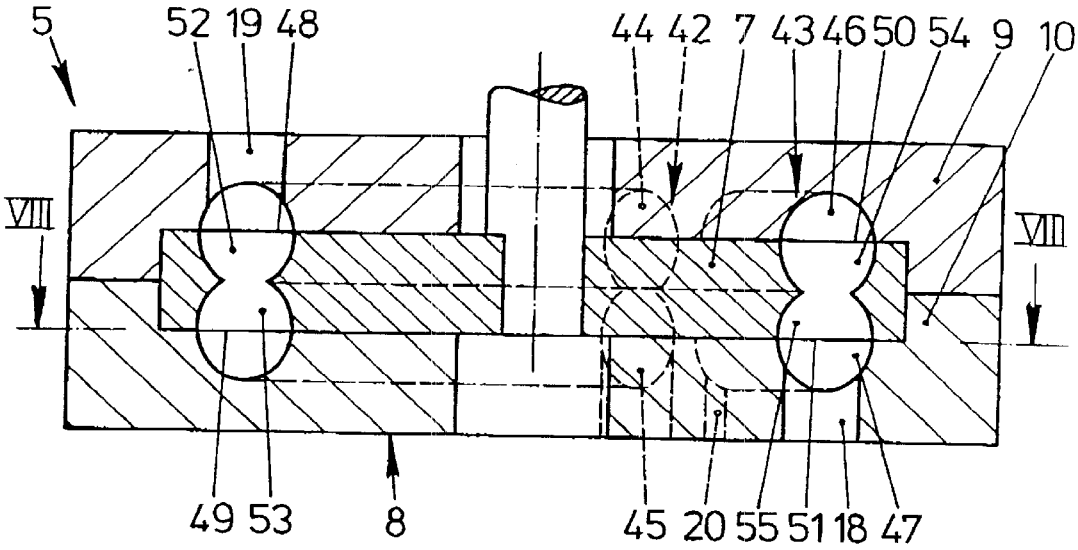
FIG. 7 is a longitudinal sectional view of the fuel pump of FIG. 1 with delivery chambers arranged one behind the other in a circumferential direction.
Figure 8:
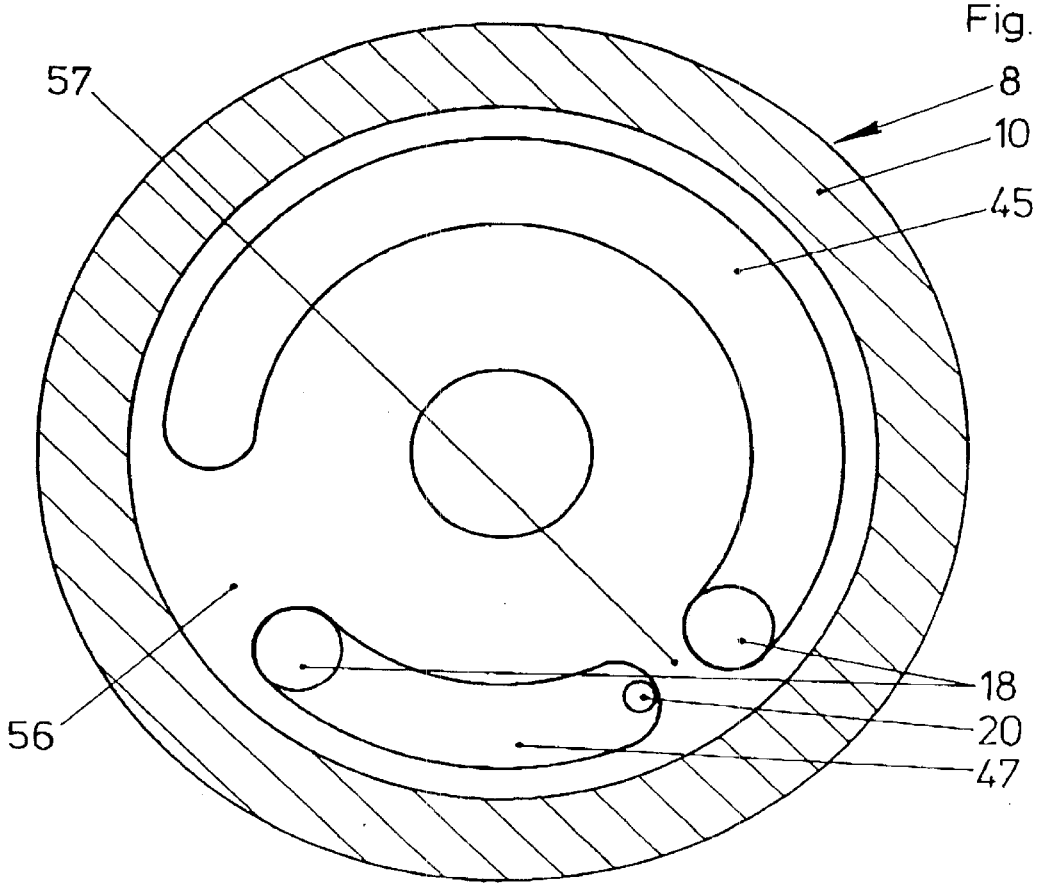
FIG. 8 is a sectional view of the fuel pump of FIG. 7 along the line VIII—VIII.

FIG. 7 shows the fuel pump 5 of FIG. 1 with two delivery chambers 42, 43 arranged one behind the other viewed in the circumferential direction of the rotor 7. The delivery chambers 42, 43 each have part-annular ducts 44 to 47 arranged in the housing parts 9, 10 and vane chambers 52 to 55 arranged in the rotor 7 and bounded by guide vanes 48 to 51. The housing part 10 includes the inlet duct 18 and is shown in FIG. 8 in a sectional representation through the fuel pump 5 of FIG. 7 along the line VIII—VIII. FIG. 8 shows that the inlet duct 18 opens into each of the part-annular ducts 45, 47 arranged in this housing part 10. The part-annular ducts 45, 47, and therefore the delivery chambers 42, 43, are separated from one another by threshold parts 56, 57 of the housing 8 which extend to the rotor 7. The part-annular duct 47 leading to the connection 20 for the entrainment fluid conduit 12 represented in FIG. 1 is substantially shorter than the part-annular duct 45 leading to the outlet duct 19. The delivery chambers 42, 43 each lead axially through the rotor 7 in the region of mutually opposite vane chambers 52 to 55.

Figure 9:
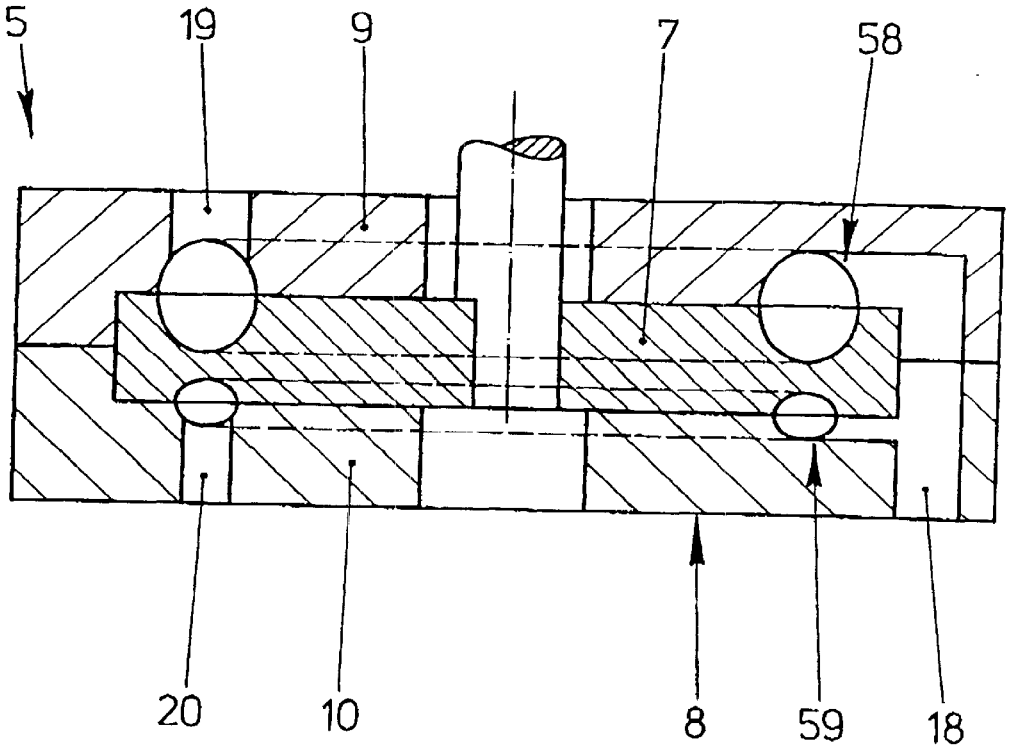
FIG. 9 is a sectional view of the fuel pump of FIG. 1 with delivery chambers located on opposite sides of the fuel pump.

FIG. 9 shows the fuel pump 5 of FIG. 1 with delivery chambers 58, 59 arranged on mutually opposing end faces of the rotor 7. The delivery chambers 58, 59 are separated from one another by the rotor 7. The delivery chamber 59 leading to the connection 20 for the entrainment fluid conduit 12 represented in FIG. 1 has a substantially smaller cross section than the delivery chamber 58 leading to the outlet duct 19. The inlet duct 18 radially adjoins each of the two delivery chambers 58, 59.

Figure 10:
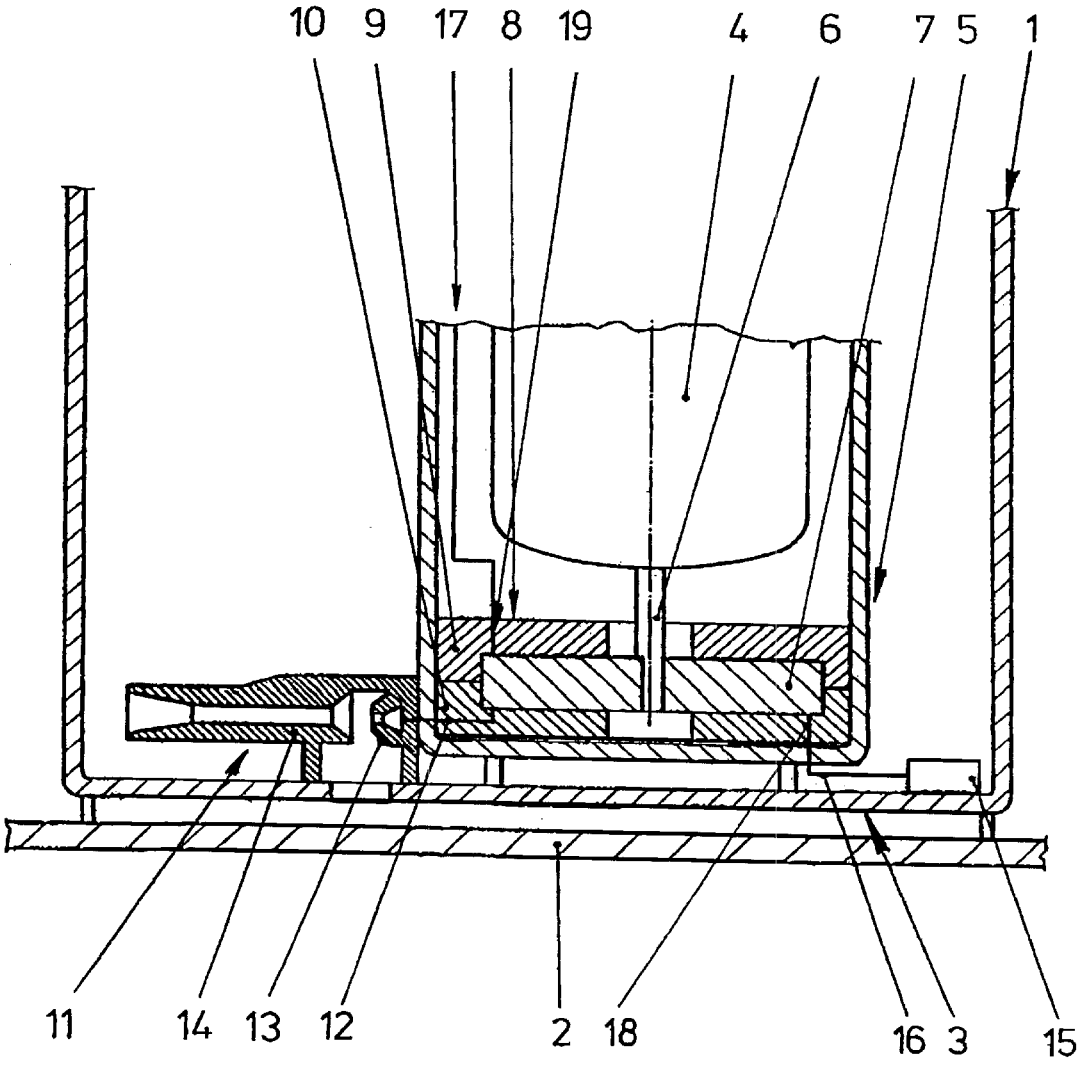
FIG. 10 is a longitudinal sectional diagrammatic view of a further embodiment of a delivery unit with a fuel pump in accordance with the present invention.

In yet a further embodiment shown in FIG. 10, the ejector 11 is arranged over an opening located in the floor of the surge chamber 1 so that fuel passes from the fuel tank 2 via the mixing tube 14 into the surge chamber 1. The delivery unit 3 is arranged laterally next to the ejector 11. The entrainment fluid conduit 12 and the mixing nozzle 13 are connected together in a suitable way. The arrangement of delivery unit 3 and ejector 11 next to one another allows the fuel pump to be located directly above the floor of the surge chamber 1. As a result, the inlet duct 18 comprises a short design, thereby achieving improved suction performance and so that the fuel pump 5 delivers fuel after only a very short time, via the conduit 17, to the internal combustion engine of the motor vehicle.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A fuel pump for arrangement in a fuel tank for delivering fuel to an internal combustion engine, comprising:

a pump housing with an inlet duct, an outlet duct, and part-annular ducts;

a rotor rotatably arranged in said pump housing and comprising vane chambers, each vane chamber comprising a ring of guide vanes arranged on said rotor, said vane chambers and said part-annular ducts forming first and second delivery chambers; and an ejector arranged for supplying fuel within the fuel tank, said pump housing further comprising a connection for supplying fuel to said ejector, wherein said first delivery chamber is connected to said outlet duct, said second delivery chamber is connected to said connection, and said first and second delivery chambers are separated from each other.

2. The fuel pump of claim 1, wherein said first and second delivery chambers are concentrically arranged such that one of said first and second delivery chambers comprises a radially inner delivery chamber and the other of said first and second delivery chambers comprises a radially outer delivery chamber.

3. The fuel pump of claim 1, wherein said inlet duct comprises a common inlet duct connected to both said first and second delivery chambers.

4. The fuel pump of claim 2, further comprising a fuel filter connected to said inlet duct, wherein said inlet duct further comprises an input end for receiving fuel from said fuel filter, an outlet end facing said rotor, and a partition extending from said input end to said output end and dividing said inlet duct into two sides, a first side of said inlet duct leading to said radially inner delivery chamber and a second side of said inlet duct leading to said radially outer delivery chamber.

5. The fuel pump of claim 1, wherein said second delivery chamber leading to said connection is smaller than said first delivery chamber leading to said outlet duct.

6. The fuel pump of claim 1, wherein said rotor comprises mutually opposing end faces and said connection and said outlet duct are arranged orthogonally to said mutually opposing end faces.

7. The fuel pump of claim 1, wherein a radially outer one of said vane chambers is arranged on an outer periphery of said rotor.

8. The fuel pump of claim 7, wherein said ring of guide vanes of said radially outer vane chamber protrudes from said outer periphery of said rotor and extends along a portion of a height of said rotor, and said one of said part-annular ducts corresponding to said radially outer vane chamber comprises a groove.

9. The fuel pump of claim 8, wherein said pump housing comprises first and second housing parts, said radially outer vane chamber comprising a groove arranged in said first housing part and laterally bounded by said second housing part.

10. The fuel pump of claim 1, wherein said first and second delivery chambers are arranged one behind the other in a circumferential direction of said rotor.

11. The fuel pump of claim 1, wherein said second delivery chamber is shorter than said first delivery chamber.

12. The fuel pump of claim 1, further comprising a fuel filter, wherein said inlet duct comprises separate inlet ducts respectively connected to each of said first and second delivery chambers.

13. The fuel pump of claim 1, wherein said inlet duct branches within said pump housing to said first and second delivery chambers.

14. The fuel pump of claim 1, wherein said rotor comprises mutually opposing end faces and said first and second delivery chambers are arranged on opposing sides of said mutually opposing end faces.

15. The fuel pump of claim 1, wherein said inlet duct is arranged for receiving fuel from the fuel tank.

16. The fuel pump of claim 1, further comprising a surge chamber having a floor, said pump housing being arranged proximate said floor of said surge chamber and said ejector being arranged laterally next to said fuel pump in said surge chamber.

* * * * *